United States Patent [19]

Lapowsky

[11] Patent Number: 5,072,790

[45] Date of Patent: Dec. 17, 1991

[54] HEAT EXCHANGER CORE CONSTRUCTION

[75] Inventor: Andrew Lapowsky, Winnipeg, Canada

[73] Assignee: Jones Environics Ltd., Winnipeg, Canada

[21] Appl. No.: 560,051

[22] Filed: Jul. 30, 1990

[51] Int. Cl.[5] ..... F28F 3/08; B21D 53/04

[52] U.S. Cl. ..... 165/166; 165/165; 29/890.039

[58] Field of Search ..... 165/165, 166; 29/890.39

[56] References Cited

U.S. PATENT DOCUMENTS

| | | | |
|---|---|---|---|
| T 911,013 | 6/1973 | Morgans et al. | 165/166 |
| 1,688,147 | 10/1928 | Levron | 165/166 |
| 1,831,533 | 11/1931 | Hubbard | 165/166 |
| 2,064,928 | 12/1936 | Lewis | 165/166 |
| 2,434,676 | 1/1948 | Spender | 165/182 |
| 2,869,835 | 1/1959 | Butt | 165/166 |
| 2,959,400 | 11/1960 | Simpelaar | 165/166 |
| 3,403,724 | 10/1968 | Gutkowski | 165/119 |
| 4,125,153 | 11/1978 | Stoneberg | 165/166 |
| 4,308,915 | 1/1982 | Sanders et al. | 165/166 |
| 4,350,201 | 9/1982 | Steineman | 165/76 |
| 4,378,837 | 4/1983 | Ospelt | 165/166 |
| 4,442,886 | 4/1984 | Dinulescu | 165/76 |
| 4,512,397 | 4/1985 | Stark | 165/166 |
| 4,527,622 | 7/1985 | Weber | 165/166 |
| 4,557,321 | 12/1985 | Von Resch | 165/166 |
| 4,681,155 | 7/1987 | Kredo | 165/76 |
| 4,848,450 | 7/1989 | Lapkowsky | 165/166 |

FOREIGN PATENT DOCUMENTS

| | | | |
|---|---|---|---|
| 464941 | 10/1925 | Fed. Rep. of Germany | 165/166 |
| 135790 | 6/1988 | Japan | 165/166 |
| 229242 | 3/1925 | United Kingdom | 165/167 |
| 900987 | 7/1962 | United Kingdom | 165/166 |

*Primary Examiner*—John Rivell
*Assistant Examiner*—L. R. Leo
*Attorney, Agent, or Firm*—Adrian D. Battison; Stanley G. Ade; Murray E. Thrift

[57] ABSTRACT

A heat exchanger core is formed by a plurality of stacked plates which are rectangular so as to define two fluid paths at right angles passing between alternate ones of the plates. The core is constructed by defining walls extending at right angles from the side edges of one of the plates and an inturned flange at the extremity of each wall. The inturned flange cooperates with a slot defined by a pair of folded portions of the next adjacent sheet so that the core is assembled by sliding two opposed slots along the cooperating flanges of the next adjacent sheet. A corner member has projections from the edges of a pair of right angle strips which projections extend into the core alternately into one fluid path and the next adjacent fluid path. Side support members similarly include a flat strip and projections into the fluid paths of the core.

13 Claims, 5 Drawing Sheets

HEAT EXCHANGER CORE CONSTRUCTION

BACKGROUND OF THE INVENTION

This invention relates to a heat exchanger core construction of a type in which the core is formed from a plurality of cut and formed metal sheets which are interconnected to form a completed core structure which can be mounted in the housing with suitable duct work to provide an effective heat exchange system.

Heat exchangers using metal cores are particularly effective in high efficiency of heat transfer and also resistant to high heat value or high pressure values in comparison with cores using plastics materials. One disadvantage of the use of metal sheets for forming the core has however been the relatively high cost of manufacture including folding and forming the sheets into a cell structure, providing suitable spaces for the cells and then assembling the space cells into a unitary core construction.

In many cases welding of the sheets to form the cell structure has been used which provides a very rigid structure which is very resistant to heat and pressure but this is of course a highly expensive process involving much labour.

The present applicant disclosed in U.S. Pat. No. 4,848,450 (Lapkowsky) issued July 18, 1989 an arrangement in which single metal sheets are folded to form upstanding walls at the edges together with a flange which is turned inwardly from the top of the upstanding wall. This structure is then interconnected by sliding each plate member into connection with the flanges of the next adjacent plate member to form an interlocking structure without the necessity for welding or individual spaces.

This construction has been highly satisfactory in producing heat exchangers of a medium and relatively large size and has been used widely for this purpose.

One problem has however arisen with an arrangement of the type shown in the above patent. When the construction is used with very large heat exchangers, the very large plates which are required can cause problems in that even very small inaccuracies in the bending process can cause adjacent plates to be slightly twisted from a directly overlying relationship leading to a core which is twisted that is the corners do not lie on a straight line but tend to twist or lie on a helix thus making it difficult to assemble the completed core into the housing.

SUMMARY OF THE INVENTION

It is a first object of the present invention, therefore, to provide a core construction of the same general type that is one using plate members which are bent to form flanges which interconnect but which can overcome or reduce the problem of manufacturing inaccuracy.

According to the first aspect of this invention, there is provided heat exchanger core for forming a first fluid path and a second fluid path which is fluid imperviously separated from the first fluid path and in heat exchanging relation therewith, said core comprising a plurality of plate members each formed from a substantially rigid sheet metal material and shaped to define a planar plate with the plate members assembled so that the plates lie in parallel stacked relationship defining between each plate and a next adjacent plate on one side a part of the first fluid path and between each plate and the next adjacent plate on an opposed side a part of the second fluid path, and connecting means coupling each alternate plate to the next adjacent plates on respective sides of said each alternate plate and defining between said each alternate plate and one of said next adjacent plates a first and a second guiding wall each bridging the space between said each alternate plate and said one plate at a respective one of two parallel edges of said each alternate plate and said one plate and forming side edges of said part of the first fluid path, said connecting means further defining between said each alternate plate and the other of said next adjacent plates a third and a fourth guiding wall each bridging the space between said each alternate plate and said other plate at a respective one or two parallel edges of said each alternate plate which parallel edges are at right angles to the parallel edges of the first and second guiding walls, said third and fourth guiding walls forming side edges of said part of the second fluid path, said connecting means including at least one first edge portion of said each alternate plate which is bent to form one of said walls and a flange at an edge of said one wall remote from said each alternate plate and bent to lie parallel to said each alternate plate and means on said one next adjacent plate defining slot means formed between first and second parallel overlying plate portions at an edge of said one next adjacent plate, the slot means lying parallel to and flat against said one next adjacent plate and receiving said flange of said each alternate plate by sliding movement thereof longitudinally of said slot means.

A further problem which arises with the construction of the above patent is that of providing an effective corner member which is attached along the corners of the core construction to integrate the structure and to provide facing strips along the corners.

It is one object of the present invention, therefore, to provide a corner member which can be used with a core construction of this general type.

According to a second aspect of the invention, there is provided heat exchanger core for forming a first fluid path and a second fluid path which is fluid imperviously separated from the first fluid path and in heat exchanging relation therewith, said core comprising a plurality of plate members each formed from a substantially rigid sheet metal material and shaped to define a planar plate with the plate members assembled so that the plates lie in parallel stacked relationship defining between each plate and a next adjacent plate on one side a part of the first fluid path and between each plate and the next adjacent plate on an opposed side a part of the second fluid path, and a corner member attached to the core along one corner between a first and a second flat face of the core, the corner member comprising a first flat strip, a second flat strip at right angles to the first and connected thereto along a common side edge thereof with each flat strip extending from the common side edge to a free side edge parallel to the common side edge, the first flat strip lying along the first face of the core, the second flat strip lying along a second face of the core, the common side edge lying along the corner, each free side edge having attached thereto a plurality of projecting members in spaced relation along the free side edge and extending from the free side edge into the core, the projecting members of the free side edge of the first flat strip being offset in a longitudinal direction of the free side edge relative to the projecting members of the free side edge of the second flat strip such that the projecting members of the first flat strip project into respective ones of the parts of the first fluid path and the projecting members of the second flat strip project into respective ones of the parts of the second fluid path.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
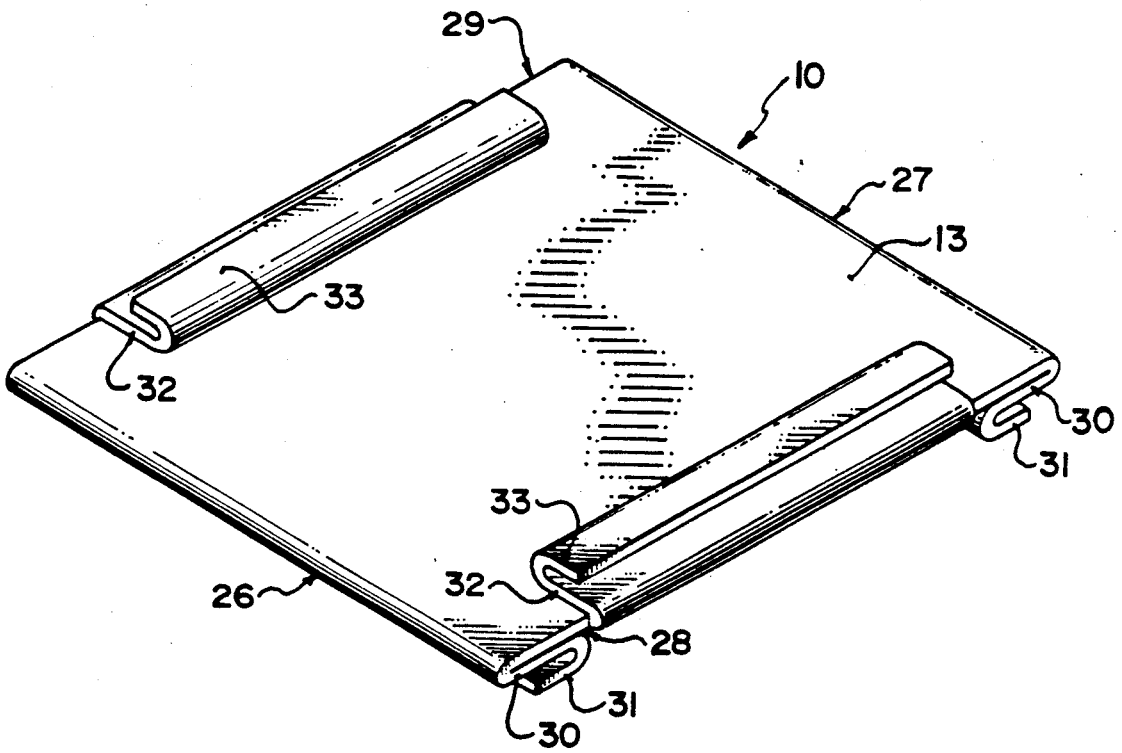
FIG. 1 is an isometric view of a first plate member for assembly into a core according to the present invention.
Figure 2:
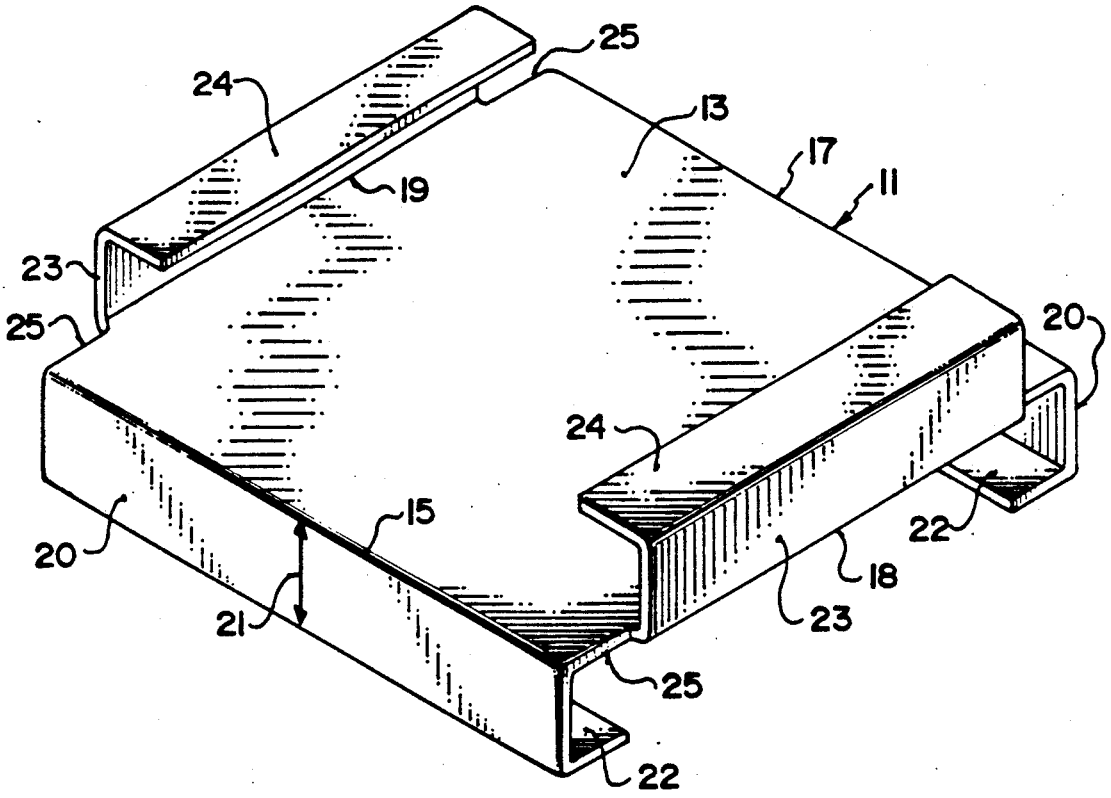
FIG. 2 is an isometric view of a second plate member for assembly with the plate member of FIG. 1 into the core construction according to the present invention.
Figure 3:
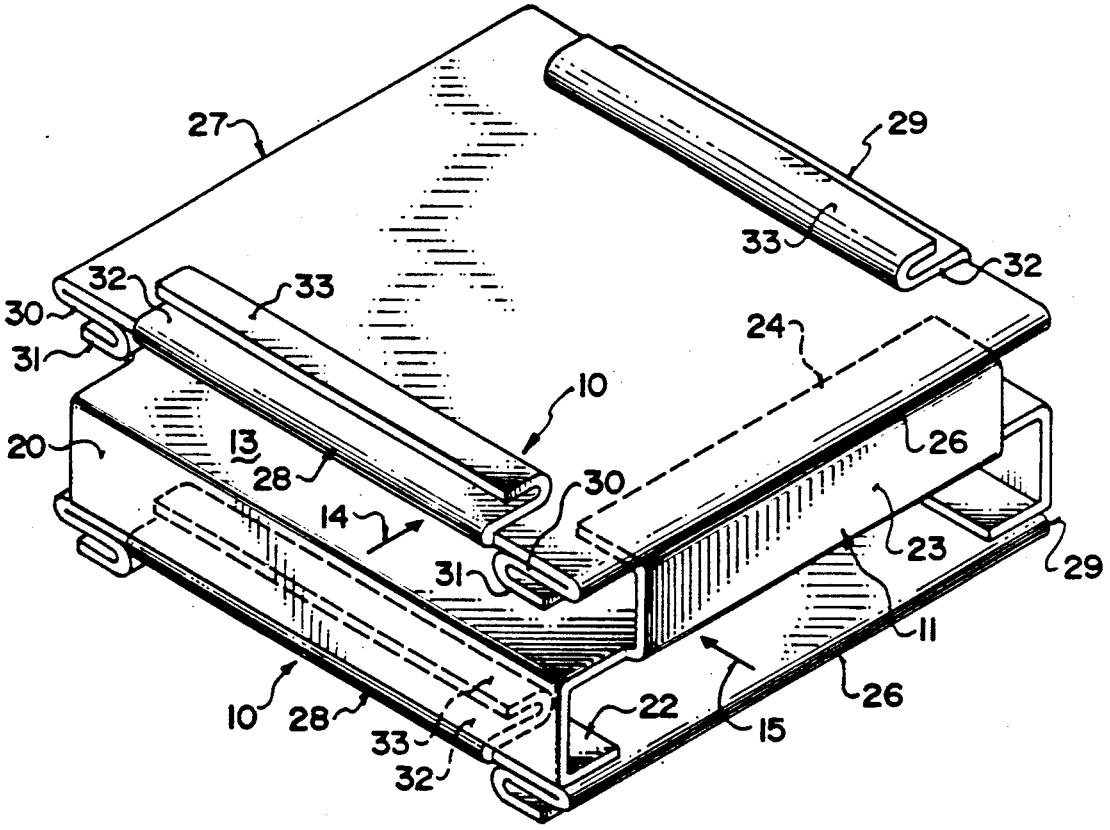
FIG. 3 is an isometric view of a part of the core construction of the present invention including the plate members of FIGS. 1 and 2.

Turning firstly to FIGS. 1, 2 and 3, the core construction is formed of two separate types of plates indicated at 10 in FIG. 1 and at 11 in FIG. 2 and these plates are connected together so as to form a stack of plates shown in FIG. 3 at 10, 11 and 10 respectively with of course the core continuing with further alternate pairs of the plates simply repeating the construction shown in the part of the core of FIG. 3. Each of the plate members of FIGS. 1 and 2 includes a substantially rectangular plate 13 so that the plates in the core construction are coextensive and overlie one another in parallel relationship to divide the core into a plurality of fluid paths.

The first of the fluid paths includes a plurality of parts of the path one of which is indicated by the arrow 14. A second of the fluid paths is indicated by the arrow 15 and is at right angles to the first of the paths. As shown only one part of each of the first and second fluid paths is shown and that part is separated from the other part by the plate 13 of the plate member 11 so that the air passing through the path 14 is separated by the fluid impervious plate 13 but in heat exchanging relationship with the path 15 by the communication of heat through the plate 13.

Turning now to FIG. 2, the plate member shown in FIG. 2 is of the same construction as that shown in the previous patent of the present applicant defined above. Thus the plate member includes the base rectangular plate 13 which has four edges 16, 17, 18 and 19 with the edges 16 and 17 parallel and the edges 18 and 19 parallel to form a rectangular flat plate. At each of the edges 16 and 17, the basic sheet from which the plate member is formed is bent to define a downturned portion 20 at right angles to the plate 13 and extending along the full length of the respective edge 16, 17. The width of the portion 20 indicated at 21 is equal to the required spacing between the plates of the second fluid path 15. At the lowermost edge of the plate portion or wall 20 is defined an inwardly turned flange 22 again running along the full length of the edge 16, 17.

As each of the edges 18 and 19 is provided a similar plate portion or wall 23 but in this case the wall is turned upwardly from the plane of the plate 13 and is again at right angles to the plate and thus is in the opposite direction to the plate 20 which is of course turned downwardly. At the top edge of the wall 23 is provided an inwardly turned flange 24 similar to the flange 22. In the case of the wall 23 and the flange 24 however this does not extend the full length of the respective edge 18, 19 but is instead rebated as indicated at 25 at both ends so that it is recessed from the respective edge 16, 17 by a distance substantially equal to or slightly greater than the width of the flange 22.

Turning now to FIG. 1, the plate member 10 includes the plate 13 which is coextensive with the plate 13 of the plate member 11 of FIG. 2. Similarly the plate has edges 26, 27, 28 and 29 which correspond to the edges of the plate 11. At the edges 26 and 27 there is provided a pair of flange portions 30 and 31 which are formed by bending the metal at the edge 26. Thus the first flange portion 30 is turned so that it lies flat against the underside of the plate 13 at the edge 26. The flange portion 31 is turned back from the edge of the flange portion 30 remote from the edge 26 so that it lies underneath and flat against the flange portion 30. The flange portion 30 and the flange portion 31 thus define a slot facing outwardly of the edge 26 with the slot parallel to the plate 13. The flange portions 30 and 31 and thus the slot extend along the full length of the edge 26 A similar slot arrangement is provided at the edge 27. In addition yet further slot arrangements of a similar construction are provided at the edges 28 and 29 respectively. In this case however the slot arrangement is defined by a flange portion 32 and a second flange portion 33. The flange portion 32 is turned back above the plate 13 and the flange portion 33 is turned back to lie above the flange portion 32 so that the slot arrangement is in this case on top of the plate 13 and facing outwardly from the edge 28. Similar arrangement is provided at the edge 29 defined by the flange portion 32 and the flange portion 33. It will be noted in all cases the second flange portion is slightly narrower than the first portion so that the edge of the flange is recessed relative to the respective edge of the plate.

Similarly to the construction shown in FIG. 2, the slot arrangements defined at the edges 28 and 29 are rebated from the respective edge 26, 27 so that there is a recess which has a width substantially equal to or slightly greater than the width of the slot arrangement along the edge 26, 27 respectively.

The assembly of the core construction is best shown in FIG. 3. Taking therefore initially the plate member 11, the upper plate member 10 is attached to the plate member 11 by sliding longitudinally so that the slot arrangement along the edges 26 and 27 cooperates with the flanges 24 with the inturned flange 24 engaging into the outwardly facing slot. The plate 10 is moved into engagement by a longitudinal sliding movement so that when it is positioned in the overlying relationship, it is held against lateral movement with a spacing between the plates defined by the height of the walls 23.

Similarly the bottom one of the plates 10 is attached t the underside of the plate 11 using the slot attached to the underside of the plate 11 using the slot arrangement a the edges 28 and 29 of the plate 10. Thus the flange 22 of the plate member 11 is held as a sliding fit between the flange portions 32 and 33 of the edge 28.

The arrangement thus shown in FIG. 3 including the slot arrangements at the edges of the plate 10 allow a sufficient degree of twisting of the plate 10 relative to the plate 11 so that any inaccuracy in locating the bends in the plate members can be accommodated by this twisting.

The flanges and slots thus formed are recessed or rebated as shown in FIG. 1 at 32 in order to facilitate the bending action on the flanges and to prevent compression or pinching of the flanges at the corners of the plate.

The construction shown in FIG. 3 thus provides a device in which the core plates are held together and properly spaced by the height of the walls 20 and 23. There is no need for welding. While the plates as shown in the drawings are very small, it will of course be appreciated that the same construction is employed where the plates are very large.

Figure 4:
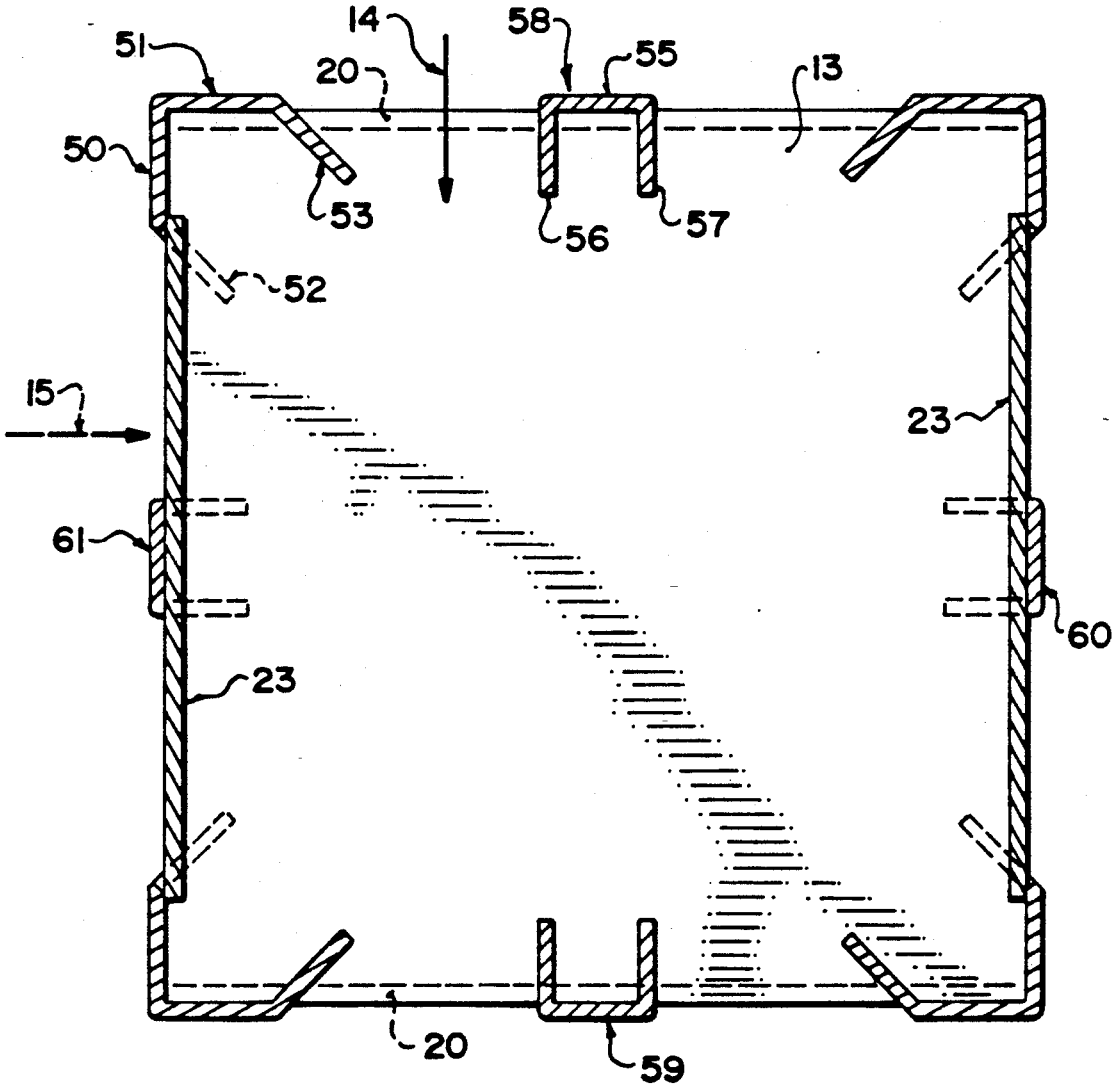
FIG. 4 is a cross sectional view of the core assembly of FIG. 3, the cross section being taken parallel to one of the plate members and including a plurality of corner members and side support members for integrating and finishing the construction shown in FIG. 3.
Figure 5:
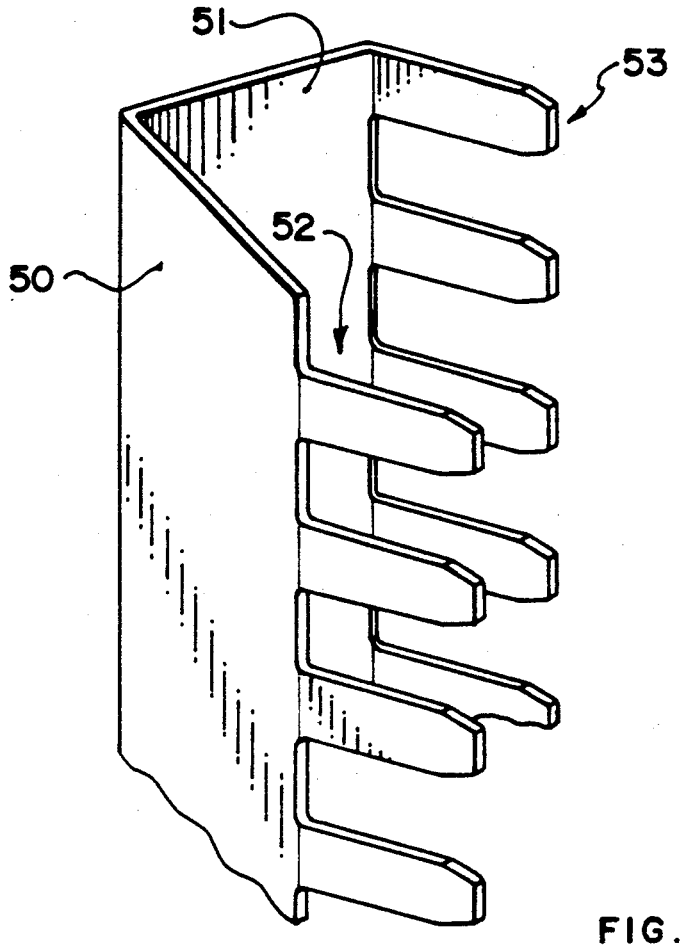
FIG. 5 is an isometric view of one of the corner members of FIG. 4.
Figure 6:
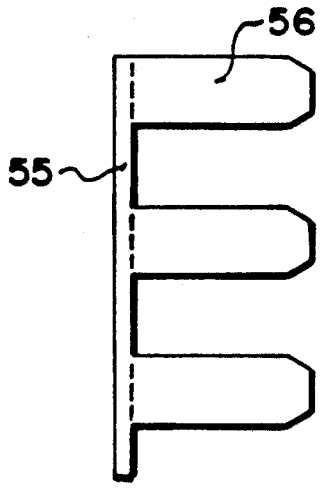
FIG. 6 is a side elevational view of one of the side support members of FIG. 4.

The core is completed by the application of corner members and side support members shown best in FIGS. 4, 5 and 6. In FIG. 4 is shown a horizontal cross section through one part of a fluid path of the core as indicated at 14 where the sides of the fluid path are defined by the upstanding walls 23 which are thus shown in cross section. The path indicated by the arrow 15 is arranged at right angles to the path 14 and passes through the next part which is not visible in FIG. 4 and is separated from the part 14 by the plate 13. The sides of the path 15 are defined by the walls 20 visible only in dashed line.

A corner member is indicated at FIG. 5 which has a length equal to the height of the core and is formed from a portion of a sheet metal material which is cut and bent to define a pair of metal strips 50 and 51 and two sets of projecting members 52 and 53. The strip members 50 and 51 are arranged at right angles so that they can be positioned as shown in FIG. 4 at the corner of the core with the strip member 50 lying along one face of the core and the strip member 51 lying along the edge of a second face of the core at right angles to the first face. The strip members 50 and 51 thus cover the coupling portions defined by the slot arrangements and flanges which are presented at the front corner of the device in FIG. 3. A suitable sealant material can be used if required for engagement between the strip members and the respective face of the core.

The projecting members 52 are arranged to extend from the free edge of the strip member 50 at an angle of 45° thereto so that they project into the core as best shown in FIG. 4. Each of the projecting members 52 is of a width equal to the spacing of the plates so that its upper edge engages on the underside of the plate and its lower edge engages on the upper side of the next adjacent plate as a friction fit so as to clamp the corner member into the core. The spacing between the projecting members 52 is equal to the spacing between the plates of the next fluid path together with the thickness of the plates themselves so that the spacing bridges the width defined by the wall 23. The projections 53 are offset from the projections 52 so that the projections 52 are aligned to spaces between the projections 53. As shown in FIG. 4 therefore the projections 53 project into the parts of the fluid path 14 whereas the projections 52 project into the parts of the fluid path 15. The projections lie parallel and at 45° to the respective strip member so that the corner member can be inserted simply into the core by moving in a directly diagonal direction.

In addition to the corner members, one or more side support members can be inserted into the core to assist in supporting the plates at the required spacing at positions between the corners. In FIG. 4 there is shown schematically simply a relatively small plate member but in a practical example, the spacing between the corner member and the side support members will of course be much greater with the necessity for one or more of the side support members between the corner members.

Each side support member is of a construction shown in FIG. 6 including a flat strip member 55 and two rows of projecting members 56 and 57 extending at right angles to the flat strip member along respective edges thereof. The spacing between the projecting members is substantially equal to the spacing between the projecting members 52 or 53 and the width of the projecting member is also the same so that the projecting members again project into the parts of the fluid path with the spaces between bridging the side walls of the other of the fluid paths. Thus in FIG. 4 the side support member indicated at 58 and 59 have projections which extend into the fluid path 14 whereas the side support members 60 and 61 have projections which extend into the parts of the fluid path 15.

The core construction therefor is a stable construction with the plates properly spaced by the corner members and the side support members and can be assembled simply by the sliding connection of the plate members as described above together with the simple frictional insertion movement of the corner members and the side support members.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed:

1. A heat exchanger core for forming a first fluid path and a second fluid path which is fluid imperviously separated from the first fluid path and in heat exchanging relation therewith, said core comprising a plurality of first plate members and a plurality of second plate members, each of said first and second plate members being formed from a substantially rigid sheet metal material of constant thickness and shaped to define a planar plate with the first and second plate members being assembled alternately so that the plates lie in parallel stacked spaced relationship, the space between the plate of each first plate member and the plate of a next adjacent second plate member on one side defining a part of the first fluid path and the space between the plate of each first plate member and the plate of the next adjacent second plate member on an opposed side defining a part of the second fluid path, and a plurality of first and second connecting means, each first connecting means coupling one of said first plate members to the next adjacent second plate member on a respective side of said one of said first plate members and defining between said one of said first plate members and said next adjacent second plate members a first and a second guiding wall each bridging the space between said one of the first plate members and said next adjacent second plate member at a respective one of two parallel edges of said one of the first plate members and said next adjacent second plate member and forming side edges of said part of the first fluid path, each second connecting means defining between one of said first plate members and the other of said next adjacent second plate members a third and a fourth guiding wall each bridging the space between said one of said first plate members and said other of said next adjacent second plate members at a respective one of two parallel edges of said one of the first plate members which parallel edges are at right angles to the parallel edges of the first and second guiding walls, said third and fourth guiding walls forming side edges of said part of the second fluid path, each of said first, second, third and fourth guiding walls comprising an edge portion of one of said first and second plate members which is bent at an angle to the planar plate to which it is attached, and each of said connecting means including a pair of slot means each slot means of said pair being defined by one of said first and second plate members and being arranged along a respective edge of the other of said first and second plate members, each slot means comprising two slot sides and a slot base interconnecting the slot sides, said slot sides both lying parallel to the planar plate of that one of said first and second plate members by which the slot means is defined, the slot base being dimensioned so as to form between said slot sides a distance substantially equal to said thickness of the sheet metal material, and said slot sides receiving therebetween an edge portion of said respective edge of the other of said first and second plate members.

2. The core according to claim 1 wherein said edge portion is arranged at an edge of a respective one of said guide walls and is bent in a direction to overlie said plate that planar plate to which said respective one of said guide walls is attached with said respective one of said guide walls defining an outermost edge of that planar plate and wherein the slot means is defined by said slot sides including a first slot side folded back to lie flat against that planar plate to which the slot side is attached and a second slot side folded back to overlie the first slot side such that the slot base faces inwardly of the edge of said planar plate.

3. The core according to claim 1 wherein said one of said first and second plate members includes both the first and second guide walls along first and second parallel edges thereof and the third and fourth guide walls along third and fourth parallel edges thereof at right angles to said first and second edges, said first and second guide walls being bent to extend away from the planar plate of the plate member to which the guide walls are attached in a direction opposite to that of the third and fourth guides walls.

4. The core according to claim 1 including a corner member attached to the core along one corner between a first and a second flat face of the core, the corner member comprising an integral body formed from sheet metal of a predetermined constant thickness bent to define a first flat strip, a second flat strip at right angles to the first and connected thereto along a common side edge thereof with each flat strip extending from the common side edge to a free side edge parallel to the common side edge, the first flat strip lying along the first face of the core, the second flat strip lying along a second face of the core, the common side edge lying along the corner, each free side edge having attached thereto a plurality of projecting blades in spaced relation along the free side edge and extending from the free side edge into the core, the projecting blades of the free side edge of the first flat strip being offset in a longitudinal direction of the free side edge relative to the projecting blades of the free side edge of the second flat strip such that the projecting blades of the first flat strip project into respective ones of the parts of the first fluid path and the projecting members of the second flat strip project into respective ones of the parts of the second fluid path, each blade comprising a part of the integral body and has side edges spaced by a width equal to a spacing between one plate and a next adjacent plate and a thickness equal to the thickness of the sheet meal such that each projecting blade of the corner member extends into the core between two plates of the core with the side edges thereof in a frictional sliding fit against the plates.

5. The core according to claim 4 wherein the projecting blades of the first flat strip lie in a common plane and wherein the projecting blades of the second flat strip lie in a second common plate with the first common plane being parallel to the second common plane.

6. The core according to claim 5 wherein the projecting blades of the first flat strip lie in a common plane which is at 45° to the first flat strip and wherein the projecting blades of the second flat strip lie in a common plane which is at 45° to the second flat strip.

7. The core according to claim 1 including a side support member attached to the core along a first flat face of the core, the side support member comprising an integral body formed from sheet metal of a predetermined constant thickness bent to define a flat strip and a plurality of projecting blades extending from the flat strip into respective ones of the parts of the first fluid path, the projecting blades lying in a common plane at right angles to the flat strip.

8. The core according to claim 7 wherein the projecting blades of the side support member have side edges spaced by a width to contact the plates of the core in a frictional sliding fit there against.

9. The core according to claim 7 wherein the flat strip includes said projecting blades along opposed side edges thereof in two parallel planes arranged at right angles to the flat strip.

10. A heat exchanger core for forming a first fluid path and a second fluid path which is fluid imperviously separated from the first fluid path and in heat exchanging relation therewith, said core comprising a plurality of plate members each formed from a substantially rigid sheet metal material and shaped to define a planar plate with the plate members assembled so that the plates lie in parallel stacked relationship defining between each plate and a next adjacent plate on one side a part of the first fluid path and between each plate and the next adjacent plate on an opposed side a part of the second fluid path, and a corner member attached to the core along one corner between a first and a second flat face of the core, the corner member comprising an integral body formed from sheet metal of a predetermined constant thickness bent to define a first flat strip, a second flat strip at right angles to the first and connected thereto along a common side edge thereof with each flat strip extending from the common side edge to a free side edge parallel to the common side edge, the first flat strip lying along the first face of the core, the second flat strip lying along a second face of the core, the common side edge lying along the corner, each free side edge having attached thereto a plurality of projecting blades in spaced relation along the free side edge and extending from the free side edge into the core, the projecting blades of the free side edge of the first flat strip being offset in a longitudinal direction of the free side edge relative to the projecting blades of the free side edge of the second flat strip such that the projecting blades of the first flat strip project into respective ones of the parts of the first fluid path and the projecting blades of the second flat strip project into respective ones of the parts of the second fluid path, each blade comprising a part of the integral body and has side edges spaced by a width equal to a spacing between one plate and a next adjacent plate and a thickness equal to the thickness of the sheet metal such that each projecting blade of the corner member extends into the core between two plates of the core with the side edges thereof in a frictional sliding fit against the plates.

11. The core according to claim 10 wherein the projecting blades of the first flat strip lie in a common plane and wherein the projecting blades of the second flat strip lie in a second common plate with the first common plane being parallel to the second common plane.

12. The core according to claim 11 wherein the projecting blades of the first flat strip lie in a common plane which is at 45° to the first flat strip and wherein the projecting blades of the second flat strip lie in a common plane which is at 45° to the second flat strip.

13. The core according to claim 10 including a side support member attached to the core along a first flat face of the core, the side support member comprising an integral body formed from sheet metal of a predetermined constant thickness bent to define a third flat strip and a plurality of further projecting blades extending from the third flat strip into respective ones of the parts of the first fluid path, the projecting blades lying in a common plate at right angles to the flat strip.

* * * * *